US006425135B1

(12) United States Patent
Aldrich

(10) Patent No.: US 6,425,135 B1
(45) Date of Patent: Jul. 30, 2002

(54) MULTI-LAYER GARMENT PAD CONSTRUCTION

(76) Inventor: Frederick W. Aldrich, P.O. Box 1364, Collingdale, PA (US) 19023

( * ) Notice: Subject to any disclaimer, the term of this patent is extended or adjusted under 35 U.S.C. 154(b) by 0 days.

(21) Appl. No.: 09/864,421

(22) Filed: May 24, 2001

(51) Int. Cl.[7] ..... A41D 13/00
(52) U.S. Cl. ..... 2/23; 2/22; 2/267
(58) Field of Search ..... 2/455, 24, 22, 2/23, 267, 62, 247, 911, 49.4, 49.5

(56) References Cited

U.S. PATENT DOCUMENTS 2,266,886 A * 12/1941 McCoy ..... 2/455
4,831,666 A 5/1989 Denman ..... 2/23
4,920,577 A 5/1990 Scharf ..... 2/24
5,134,726 A 8/1992 Ross ..... 2/23
5,592,689 A 1/1997 Matthews ..... 2/23
5,896,580 A 4/1999 Aldrich et al. ..... 2/24
5,920,902 A * 7/1999 Crampton ..... 2/24

* cited by examiner

*Primary Examiner*—Gloria M. Hale
*Assistant Examiner*—Tejash Patel
(74) *Attorney, Agent, or Firm*—Henderson & Sturm LLP

(57) ABSTRACT

A multi-layer garment pad construction (10) for attachment to the interior surface (101) of a garment (100) on the knee or elbow portion. The construction (10) including a waterproof layer (11) and a padded layer (12) frictionally associated with one another and also frictionally associated respectively with an outer adhesive layer (13) and an inner overlap layer (14) which are fixedly joined to one another to form a sealed chamber surrounding the waterproof (11) and padded (12) layers.

6 Claims, 2 Drawing Sheets

MULTI-LAYER GARMENT PAD CONSTRUCTION

CROSS REFERENCE TO RELATED APPLICATIONS

This application is an improvement over U.S. Pat. No. 5,896,588, which issued on Apr. 27, 1999, and is entitled "Multi-Layer Knee Pad Construction."

BACKGROUND OF THE INVENTION

1. Field of the Invention

The present invention relates to the field of protective padding devices in general, and in particular to a multi-layer, waterproof, cushioned pad construction for garments.

2. Description of Related Art

As can be seen by reference to the following U.S. Pat. Nos. 4,831,666; 4,920,577; 5,134,726; and, 5,592,689, the prior art is replete with myriad and diverse protective knee pad constructions.

While all of the aforementioned prior art constructions are more than adequate for the basic purpose and function for which they. have been specifically designed, they are uniformly deficient with respect to their failure to provide a simple, efficient, and practical protective garment pad construction that can be ironed onto the interior knee or elbow portion of a garment to provide a low profile waterproof, cushioned pad construction that will protect the user's knees or elbows.

As any gardener, construction worker, or parent with small children is all too well aware, the presence of a protective knee covering is an absolute necessity under virtually all circumstances.

As a consequence of the foregoing situation, there has existed a longstanding need for a new and improved type of garment pad construction that employs a multilayer construction that is waterproof, cushioned, and low friction, and the provision of such a construction is a stated objective of the present invention.

BRIEF SUMMARY OF THE INVENTION

Briefly stated, the improved garment pad construction that forms the basis of the present invention comprises in general an outer contact layer, a waterproof layer, a padded layer and an inner overlap layer that are operatively associated with one another in a specific fashion and are adapted to be operatively connected to a selected interior surface of a garment so that the presence of the pad construction is not readily apparent.

As will be explained in greater detail further on in the specification, the outer and inner layers are joined together in a specific fashion to form a sealed chamber that envelops the waterproof layer and the padded layer wherein the waterproof layer frictionally engages both the outer layer and one side of the padded layer, and the other side of the padded layer only frictionally engages the inner overlap layer.

In addition, the friction-only contact between the waterproof and padded layers resists the bunching of those layers within the chamber formed by the inner and outer layers.

Furthermore, this invention also contemplates fabricating the waterproof layer from two generally identical rectangular sheets of neoprene whose inner surfaces are in frictional contact with one another and whose outer surfaces are in frictional contact with the padded layer and the outer contact layer to further reduce any bunching that might normally occur within the chamber formed by the inner and outer layers.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
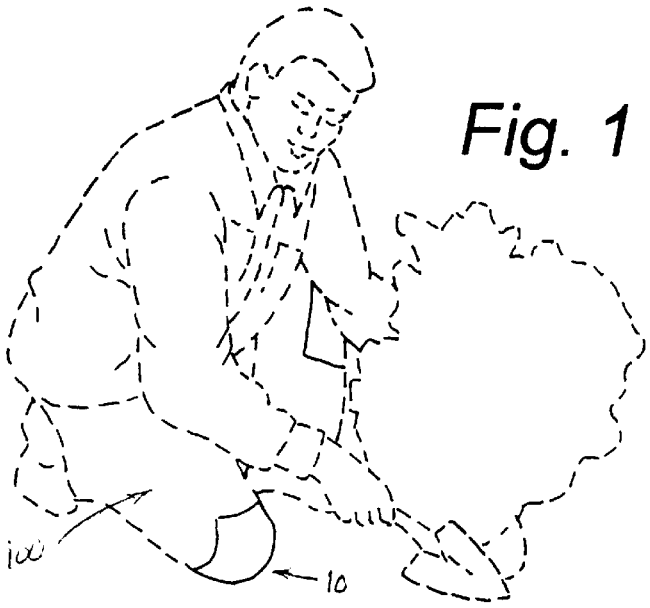
FIG. 1 is a perspective view of the protective garment pad construction that forms the basis of the present invention in use.
Figure 2:
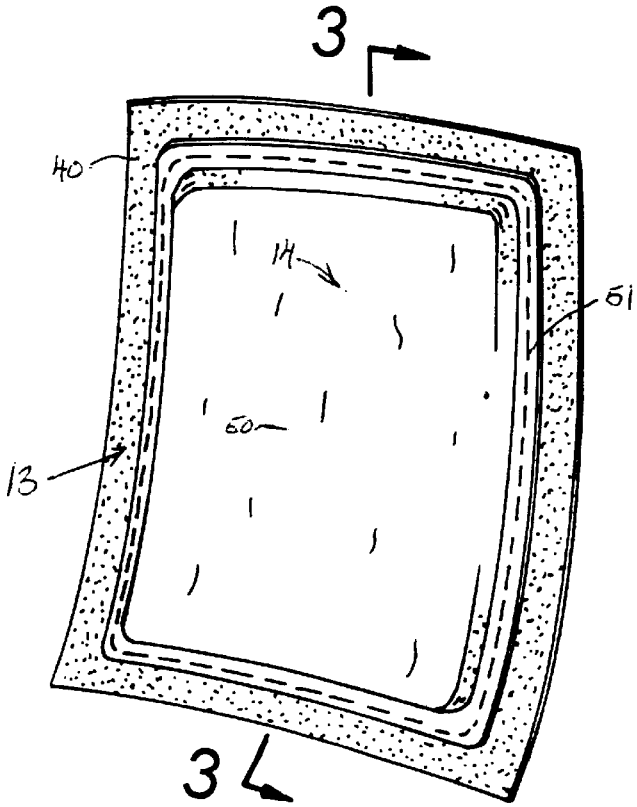
FIG. 2 is a rear perspective view of the knee pad construction.
Figure 3:
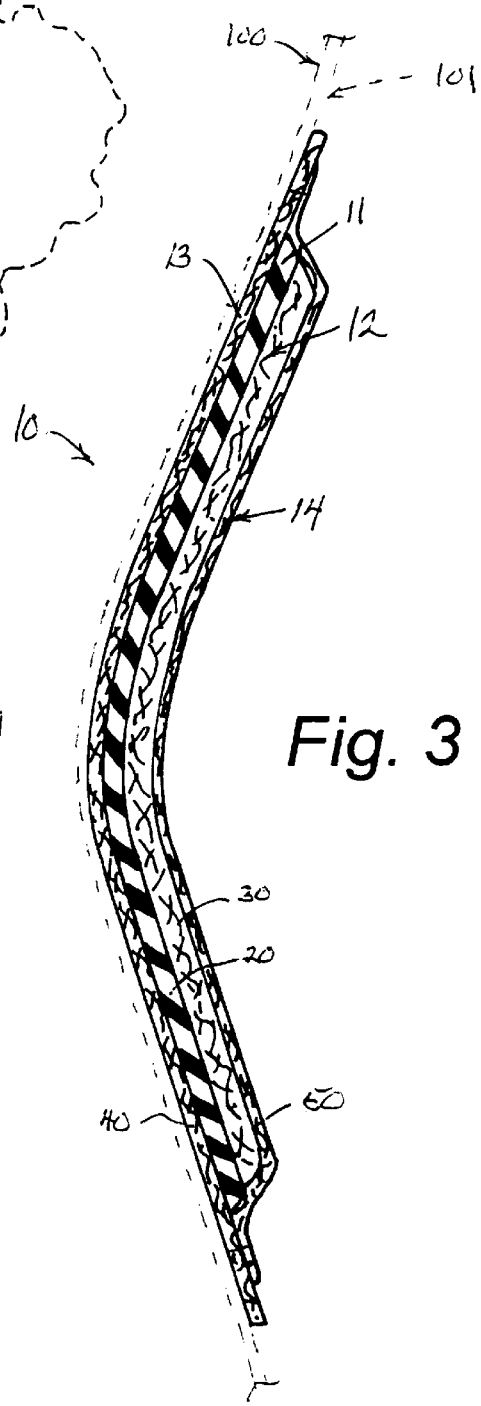
FIG. 3 is a cross-sectional view taken through line 3—3 of FIG. 2.

As can be seen by reference to the drawings, and in particular to FIG. 3, the improved multi-layer garment pad construction that forms the basis of the present invention is designated generally by the reference number 10. The pad construction 10 comprises in general a waterproof layer 11, a padded layer 12, an outer adhesive layer 13, and an overlap layer 14. These layers will now be described in seriatim fashion.

Figure 4:
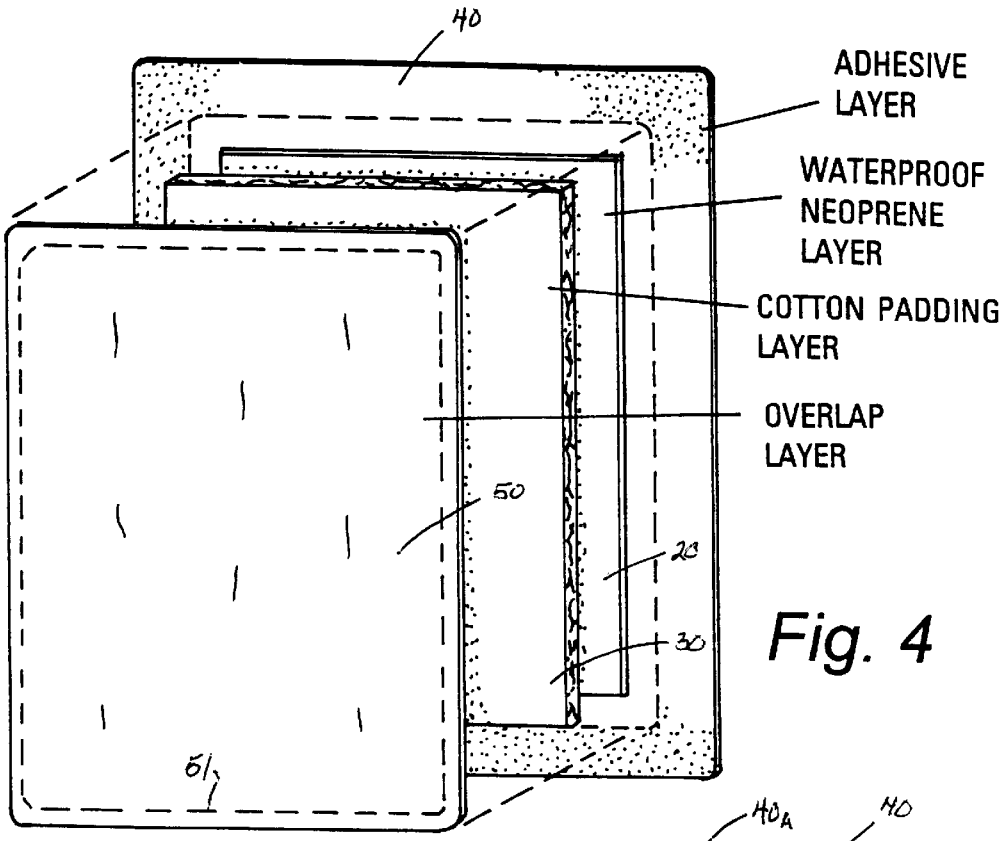
FIG. 4 is an exploded rear perspective view of the first version of the preferred embodiment of this invention; and, FIG. 5 is an exploded rear perspective view of the second version of the preferred embodiment of this invention.

As shown in FIGS. 3 and 4, in the first version of the preferred embodiment, the waterproof layer 11 comprises a single generally rectangular sheet of neoprene rubber material 20 having an enlarged thickness $T_1$, which provides a generally resilient waterproof barrier for the pad construction 10.

In addition, the padded layer 12 comprises a generally rectangular sheet of padding material 30 such as non-woven cotton batting, fleece, or the like wherein the overall dimensions and thickness of the waterproof layer 11 and the padded layer 12 are essentially the same.

Still referring to FIGS. 3 and 4, it can be seen that the outer contact layer 13 comprises an enlarged generally rectangular sheet of cloth fabric 40 preferably fabricated from a poly/cotton blend material and having an outer face $\mathbf{40}_A$ provided with a heat activated adhesive for securing the outer adhesive layer 13 to the interior surface 101 of a garment 100 such as the elbow portion of a shirt or jacket or the knee portion of a pair of pants.

Furthermore, the inner overlap layer 14 comprises a reduced dimension generally rectangular sheet of low friction material 50 such as a poly/blend fabric having an inner face $\mathbf{50}_A$ provided with a heat activated adhesive coating; wherein, the exterior dimensions of the inner overlap layer 14 are slightly larger than the exterior dimensions of the waterproof 11 and padded layers and substantially smaller than the exterior dimensions of the outer adhesive layer 13 such that the inner overlap layer 13 may be fixedly engaged to the outer adhesive layer 14 by either the heat activated adhesive coating $\mathbf{50}_A$ or by stitching 51 to captively engage the padded layer 12 and the waterproof layer 11 intermediate the inner 13 and outer 14 layers in a well recognized fashion.

Figure 5:
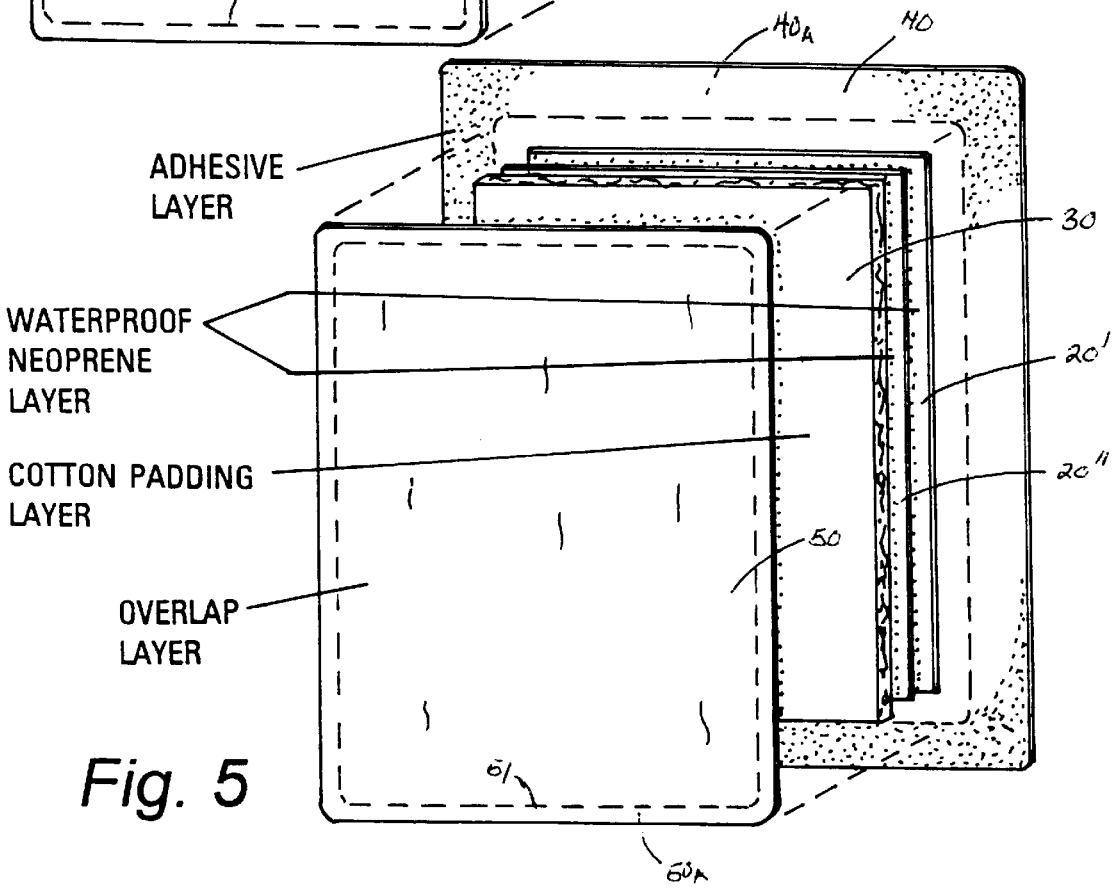

Turning now to FIG. 5, it can be seen that the only difference between the first and second preferred embodiments of this invention is the fact that in the second version of the preferred embodiment, the waterproof layer 11 comprises a pair of generally identical rectangular sheets of neoprene material 20' and 20" having thicknesses $T_2$ and $T_3$ respectively; wherein, the combined value of thicknesses $T_2$ and $T_3$ is equal to the thickness $T_1$ in the first version of the preferred embodiment wherein the preferred value of $T_1$ is approximately ?????????????

It should be noted at this juncture that in both versions of the preferred embodiment there is only frictional engagement between the opposed surfaces of the waterproof layer 11 and the padded layer 12, as well as between the waterproof layer 11 and the outer adhesive layer 14 and the padded layer 12 relative to the overlay layer 13. The reason for this relationship being not only ease of fabrication of the pad construction 10, but also to minimize the possibility that the waterproof layer 11 and/or the padded layer 12 will become bunched within the sealed chamber formed between the outer adhesive layer 14 and the inner overlay layer 13.

It should further be noted that the use of the pair of neoprene sheet 20' 20" in the second version of the preferred embodiment further enhances this anti-bunching feature of the finished pad construction 10 in that both of the neoprene sheets 20' and 20" are movable relative to one another.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A garment pad construction for use on the interior surface of a garment wherein the pad construction comprises an outer layer including a first generally enlarged rectangular sheet of cloth fabric having an inner face and an outer face adapted to be fixedly secured to a selected inner surface of a garment a waterproof layer including a pair of generally rectangular sheets of neoprene material each having a first side and a second side wherein, the sheets of neoprene material are only frictionally engaged relative to one another and wherein one of the pair of sheets of neoprene material is only frictionally engaged with the inner face of the outer layer a padded layer including a generally rectangular sheet of padding material having a first side which only frictionally engages the other of said pair of sheets of neoprene material and having a second side; and, an inner overlap layer including a second reduced dimension generally rectangular sheet of cloth fabric having an inner face that is adapted to be fixedly engaged to the inner face of the outer layer and only frictionally engaged with said second side of the padded layer.

2. The pad construction as in claim 1; wherein, the outer face of the outer layer is provided with a heat activated adhesive coating.

3. The pad construction as in claim 2; wherein at least selected portions of the inner face of the second generally rectangular sheet of cloth fabric are provided with a heat activated adhesive coating.

4. The pad construction as in claim 2; wherein, the overlap layer is fixedly connected to the outer layer by stitching.

5. The pad construction as in claim 2; wherein, the waterproof layer and the padded layer have the same overall dimensions.

6. The pad construction as in claim 5; wherein, the overlap layer has overall dimensions that are greater than the individual overall dimensions of the waterproof layer and the padded layer and wherein the overall dimensions of the overlap layer are smaller than the overall dimensions of the outer layer.

* * * * *